US005524677A

United States Patent [19]

Summey, III

[11] Patent Number: 5,524,677

[45] Date of Patent: Jun. 11, 1996

[54] DOFFING A CLOTH ROLL USING A DC MOTOR UNDER FULL POWER

[75] Inventor: Shala W. Summey, III, Greenville, S.C.

[73] Assignee: Alexander Machinery, Inc., Mauldin, S.C.

[21] Appl. No.: 293,385

[22] Filed: Aug. 19, 1994

[51] Int. Cl.[6] ..... D03D 49/20

[52] U.S. Cl. ..... 139/1 E; 139/1 R; 139/291 R; 242/533.2; 242/542; 318/6

[58] Field of Search ..... 318/6, 7, 105, 318/106, 108, 433, 432, 431, 533.2, 542; 242/413.9, 414.1, 51, 413.5, 413.7; 139/311, 1 E, 1 R, 291 R

[56] References Cited

U.S. PATENT DOCUMENTS

| | | | |
|---|---|---|---|
| 3,609,486 | 9/1971 | Feldhoff | 318/138 |
| 3,962,616 | 8/1976 | Smith | 318/400 |
| 4,203,563 | 5/1980 | Alexander, III et al. | 242/542 |
| 4,280,081 | 7/1981 | Dinger et al. | 318/6 |
| 5,162,717 | 11/1992 | Tamura | 318/431 X |
| 5,313,988 | 5/1994 | Bilcke et al. | 139/1 E |

*Primary Examiner* Andy Falik
*Attorney, Agent, or Firm* Ralph Bailey

[57] ABSTRACT

A doffing mechanism wherein a cloth roll doffer (C) is normally carried in aligned laterally spaced relation to the cloth roll with a motor which are actuated by manually raising the cloth roll engaging means to forcefully move the cloth roll engaging means for doffing the full cloth roll into a cart positioned beside the takeup rolls for receiving and carrying away the cloth roll. A DC motor (E) drives the takeup, and a DC motor control has a bridge rectifier (F) in an armature circuit of the DC motor supplying full armature current to the motor during doffing.

7 Claims, 3 Drawing Sheets

Fig. 3-A.

DOFFING A CLOTH ROLL USING A DC MOTOR UNDER FULL POWER

BACKGROUND OF THE INVENTION

This invention relates to apparatus for doffing a cloth roll from a loom cloth takeup and more particularly to a DC motor control including a bridge rectifier permitting full armature current to the motor for the period of doffing. This invention is an improvement useful with the apparatus of U.S. Pat. No. 4,203,563.

Cloth rolls when employed in connection with takeup apparatus of the type usually positioned in front of the loom utilizing a pair of parallel spaced rolls, are normally built to very large sizes, and often weigh on the order of two thousand pounds. The doffing of such heavy rolls requires special lifting mechanism with personnel assigned to utilize such equipment. The doffing apparatus facilitates the doffing of the large cloth roll by regular personnel in a manual operation. The doffing equipment is simple in construction and design and requires little maintenance.

Accordingly, it is an important object of the present invention to simplify the doffing of large cloth rolls by use of inexpensive manually operated doffing mechanism.

Another important object of the invention is the provision of a doffing apparatus with few moving parts which is manually operable only at the time the doffing operation is required for removing cloth rolls into carts for removing the cloth rolls for subsequent finishing operations.

Still another object of the present invention is to reduce equipment cost and maintenance while making it possible for regular weaving personnel to carry out the doffing operations related to very large loom cloth takeup rolls.

Apparatus has been employed heretofore which utilized fluid operated cylinders in connection with the doffing of the large rolls such as illustrated in U.S. Pat. No. 3,286,944. Such devices require the use of power operated mechanism and in the device illustrated in the patent, it is necessary to first remove the roll from the takeup or winding mechanism. The apparatus of the present invention on the other hand, removes the cloth roll from the takeup rolls.

Another important object of this invention is to temporarily enhance the capabilities of a DC motor takeup drive utilizing a bridge rectifier.

SUMMARY OF THE INVENTION

It has been found that doffing apparatus may be provided for removing the large cloth rolls from loom takeups by providing a manually engageable drive mechanism engageable with the takeup drive mechanism for urging cloth roll engageable means into engagement with the cloth roll removing the cloth roll from the takeup. A suitable DC motor control is preferably operated responsive to a suitable tension sensing apparatus such as illustrated in U.S. Pat. No. 4,216,804.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3A is a partial circuit diagram illustrating an alternate form of control circuitry wherein a half wave rectifier is utilized in the armature circuit of the DC motor in lieu of the full wave rectifier of FIG. 3.

DESCRIPTION OF A PREFERRED EMBODIMENT

Figure 1:
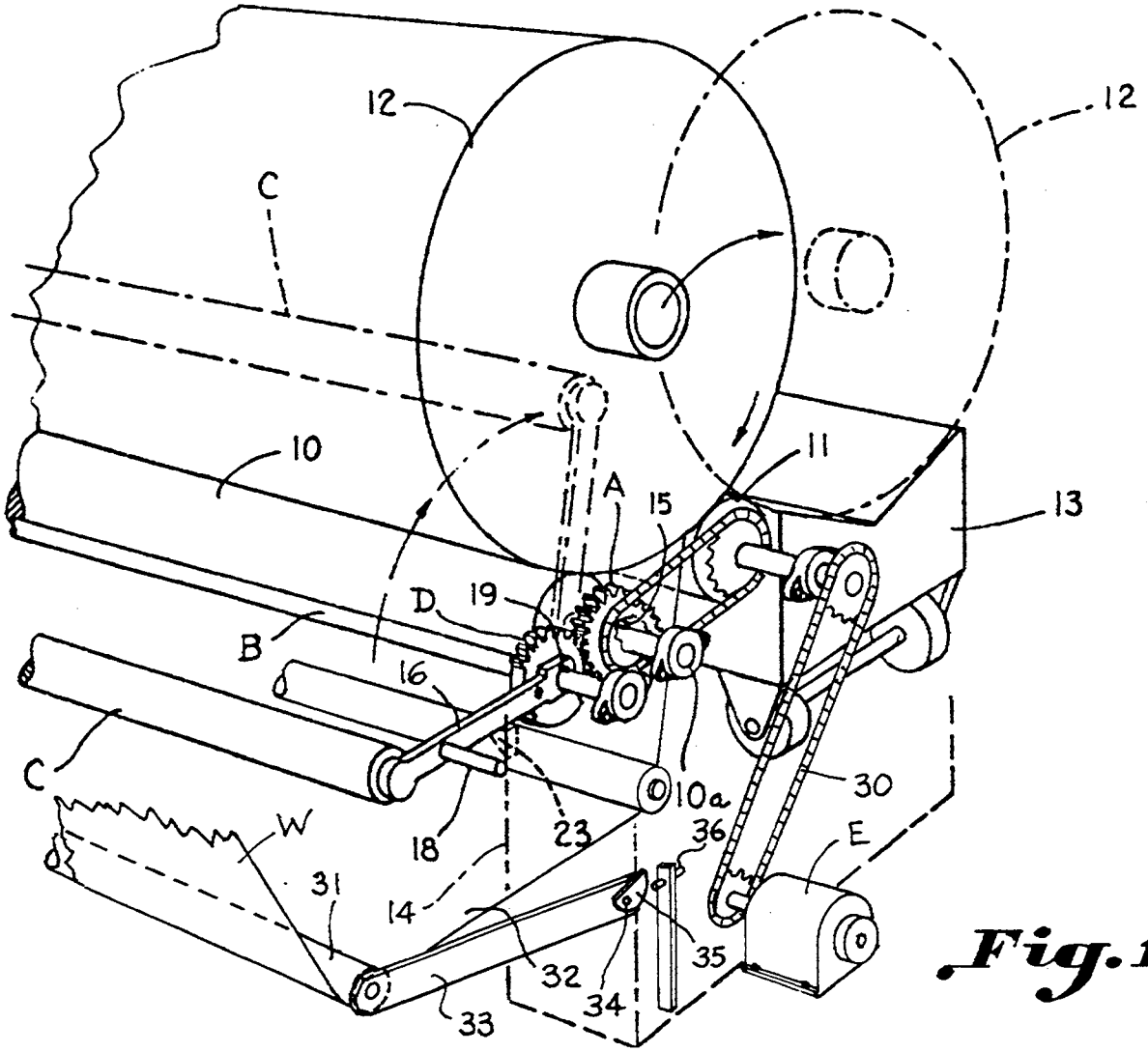
FIG. 1 is a perspective view illustrating a doffing apparatus and tension sensing mechanism therefor constructed in accordance with the present invention positioned upon a loom takeup mechanism having driven spaced aligned rolls carried in front of a loom, the cloth roll having been fully built preparatory to doffing.

A doffing apparatus is illustrated for a loom takeup of the type having a pair of driven spaced aligned rolls supporting therebetween a cloth roll. The takeup is positioned in front of the loom and the cloth is fed thereto from the loom for winding into a large roll. A driving gear A is carried in driven relation to one of the spaced aligned rolls. A shaft B is carried for oscillation in alignment with the spaced aligned rolls. Cloth roll engaging means in the form of a suitable doffer roll C is fixed in laterally spaced alignment with the shaft. A gear segment D is carried in fixed relation to the shaft. Thus, the gear segment D may be moved into engagement with the driving gear A urging the cloth roll engaging means in the form of a doffer roll C into engagement with the cloth roll, urging same out of its supported position between the spaced aligned rolls.

Apparatus for operating a doffer includes a DC motor E driving the support rolls of the loom takeup in a direction to wind cloth upon the cloth roll during weaving. A DC motor control operating the DC motor for maintaining predetermined tension in the cloth wound upon the takeup during weaving has a bridge rectifier F in an armature circuit of the DC motor supplying full armature current to the motor when the direction of the motor is reversed during doffing. The doffer may be manually engaged as described above for operation by the rolls and their direction reversed during doffing. Thus, the DC motor delivers full power for the brief period of time necessary for doffing.

The loom cloth takeup includes a pair of driven spaced aligned takeup rolls 10 and 11. The takeup rolls support the cloth roll 12 which is illustrated herein as being fully wound or built and ready for doffing upon the cart 13. The frame member or stand 14, shown in broken lines, serves as a support for the takeup rolls 10 and 11. The driving gear A is illustrated as being fixed to the shaft 10*a* of the roll 10 as by a key 15 so as to be driven thereby. The shaft B is supported for rotation upon the stand 14 at one end.

Figure 2:
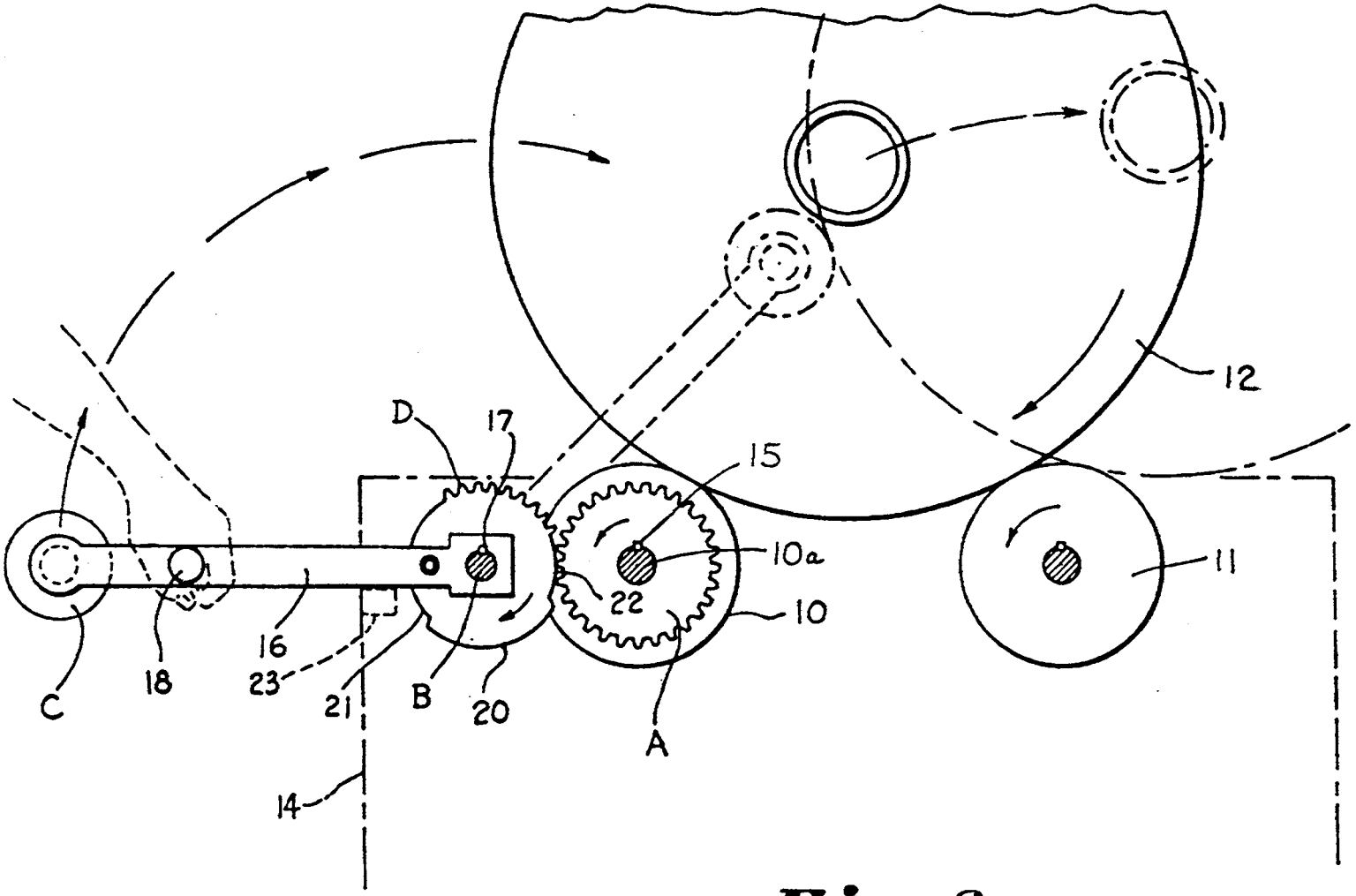
FIG. 2 is an enlarged side elevation illustrating the doffing apparatus of FIG. 1 in greater detail.

The doffer roll C is carried for rotation adjacent one end of the arms 16 which have fixed connection with the shaft B as by a key 17 (FIG. 2). A handle 18 is illustrated as being carried intermediate the ends of the arms 16.

A gear segment D is fixed to the shaft B as by a key 19. The gear segment is cut in a disk and an opposite portion is blank as illustrated at 20 in FIG. 2. Intermediate opposed portions of the disk are reduced as illustrated at 21 and 22, respectively.

A bracket 23 is carried inside the stand 14 for supporting the arm 16 in convenient position to be manually raised to effect a doffing operation. This is accomplished after the cloth roll is fully built and the takeup drive is reversed to turn the rolls in the direction of the arrows in the drawings.

It is thus seen that simplified apparatus has been provided which is manually engageable with the already provided takeup mechanism which is manually engageable when the takeup mechanism is reversed in direction for manually doffing the takeup roll.

In FIG. 1 a Direct Current (DC) motor E is illustrated as driving the roll 11 through the chain 30. The cloth W passes beneath the moveable tension sensing roll 31 and is supported by a horizontal run of cloth 32 on its way to be wound upon the roll 12. The roll 31 is carried by spaced arms 33 (only one of which is shown in FIG. 1) to turn a pivoted shaft 34. A cam 35 is fixed to the shaft 34 for actuating the proximity switch 36.

Figure 3:
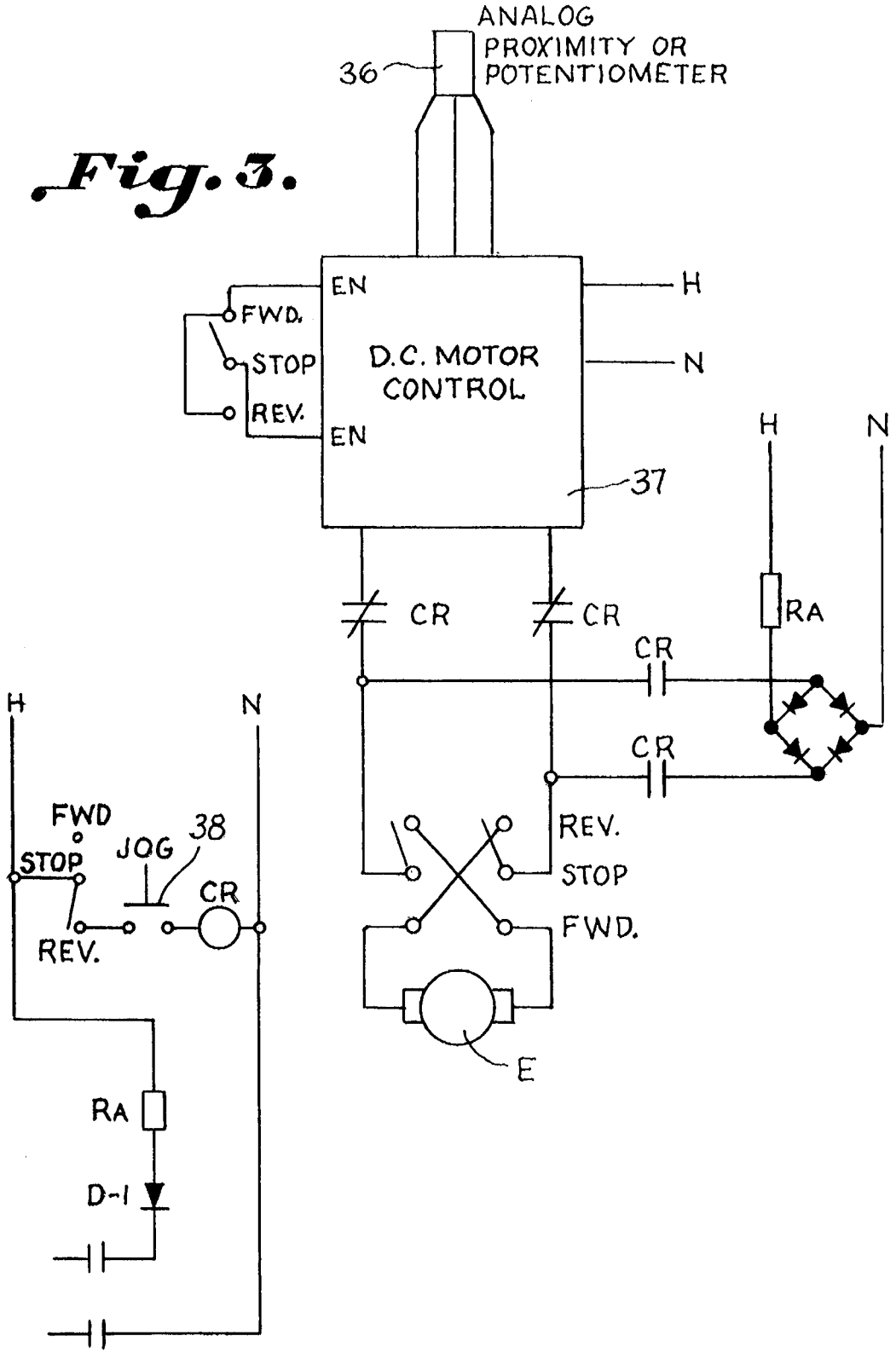
FIG. 3 is a circuit diagram illustrating control circuitry constructed in accordance with the invention.

Because of the torque required, a DC motor control 37 (unless for an oversized motor) would not be capable of doffing a fabric roll as shown in FIG. 3. As a result, the drive would ordinarily go into current limiting mode and provide insufficient current to the motor E. By providing power to a bridge rectifier F across the lines H and N in the circuit, the motor control is disabled when the jog button is depressed and the bridge rectifier is enabled.

FIG. 3A illustrates the use of a half wave rectifier including the diode D-1 in lieu of the preferred bridge circuit incorporating four diodes illustrated in FIG. 3 to provide power to the doffing circuit.

When doffing the takeup is reversed and the bridge rectifier F is placed into the circuit when the jog push button 38 is depressed and the doffer engaged as described above. This enables full armature current to be employed by the motor E. In most instances between 8 and 10 times the normal armature current is required momentary (for 2 or 3 seconds) to doff a fabric roll. The resistor $R_a$ limits the maximum current to the bridge rectifier and motor.

Thus, a circuit consisting of between one and four diodes may be used in the armature circuit to provide armature current to the DC motor in order to supply sufficient power to doff and when not doffing limits current adjustably to suit the capability of the motor.

While a preferred embodiment of the invention has been described using specific terms, such description is for illustrative purposes only, and it is to be understood that changes and variations may be made without departing from the spirit or scope of the following claims.

What is claimed is:

1. Apparatus for removing a cloth roll from a pair of spaced parallel aligned support rolls driving said cloth roll upon a loom takeup comprising:

a doffer;

a DC motor adapted to drive said support rolls of said loom takeup in a direction to wind cloth upon the cloth roll during weaving;

a DC motor control operating said DC motor for maintaining predetermined tension in the cloth wound upon the takeup during weaving;

a rectifier including a diode in an armature circuit of said DC motor for supplying full armature current to the motor to produce full power for driving said support rolls during doffing; and means driven by said support rolls for engaging said doffer for removing said cloth roll from said support rolls.

2. The structure set forth in claim 1 wherein said rectifier is a full wave bridge rectifier.

3. The structure set forth in claim 1 including a resistor limiting the maximum current to the bridge rectifier and motor during doffing.

4. The structure set forth in claim 1 including means for reversing said cloth rolls during doffing, and further including a doffing gear adapted to be driven by one of said support rolls when its direction is reversed and when manually engaged for actuating said doffer.

5. The structure set forth in claim 1 wherein said motor control is operated by a sensing roll carried by pivoted arms and supported by a horizontal run of cloth during weaving.

6. The method of removing a cloth roll from a pair of spaced parallel aligned support rolls driving said cloth roll upon a loom takeup comprising the steps of:

providing a doffer utilizing a DC motor driving said support rolls of said loom takeup in a direction to wind cloth upon the cloth roll during weaving:

operating said DC motor at a first power level for maintaining predetermined tension in the cloth wound upon the takeup during weaving:

providing a rectifier including a diode in an armature circuit of said DC motor for supplying full armature current to said motor to provide increased power to said doffer during doffing; and utilizing said increased power for operating said doffer for removing said cloth roll from said support rolls.

7. The method set forth in claim 6 including the step of utilizing a sensing roll supported by a horizontal run of cloth during weaving for operating a motor control.

* * * * *